US007661979B2

(12) United States Patent
Hughes et al.

(10) Patent No.: US 7,661,979 B2
(45) Date of Patent: Feb. 16, 2010

(54) JACKET SLEEVE WITH GRIPPABLE TABS FOR A CABLE CONNECTOR

(75) Inventors: David Charles Hughes, Rubicon, WI (US); John Mitchell Makal, Menomonee Falls, WI (US); Michael John Gebhard, Sr., Waukesha, WI (US); Paul Michael Roscizewski, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/809,508

(22) Filed: Jun. 1, 2007

(65) Prior Publication Data

US 2008/0299818 A1 Dec. 4, 2008

(51) Int. Cl.
*H01R 13/56* (2006.01)

(52) U.S. Cl. ..... 439/445; 174/84 R

(58) Field of Classification Search ..... 439/181, 439/445, 921; 174/84 R, DIG. 8
See application file for complete search history.

(56) References Cited

U.S. PATENT DOCUMENTS

| | | | |
|---|---|---|---|
| 1,903,956 | A | 4/1933 | Christie et al. |
| 2,953,724 | A | 9/1960 | Hilfiker et al. |
| 3,115,329 | A | 12/1963 | Wing et al. |
| 3,315,132 | A | 4/1967 | Raymond |
| 3,392,363 | A | 7/1968 | Geis, Jr. et al. |
| 3,471,669 | A | 10/1969 | Curtis |
| 3,474,386 | A | 10/1969 | Link |
| 3,509,516 | A | 4/1970 | Phillips |
| 3,509,518 | A | 4/1970 | Phillips |
| 3,513,425 | A | 5/1970 | Arndt |
| 3,539,972 | A | 11/1970 | Silva et al. |
| 3,542,986 | A | 11/1970 | Kotski |
| 3,546,535 | A | 12/1970 | Van Riemsdijk |
| 3,576,493 | A | 4/1971 | Tachick et al. |

(Continued)

FOREIGN PATENT DOCUMENTS

| | | |
|---|---|---|
| DE | 3110609 | 10/1982 |

(Continued)

OTHER PUBLICATIONS

U.S. Appl. No. 11/738,995, Steinbrecher et al.

(Continued)

*Primary Examiner*—Thanh-Tam T Le
(74) *Attorney, Agent, or Firm*—King & Spalding LLP

(57) ABSTRACT

A jacket sleeve with grippable tabs provides protection to exposed portions of cable that are connected to an electrical connection. The jacket sleeve can be made as part of the electrical connector or may be connected subsequent to its creation through the use of glues or other adhesives. The jacket sleeve can be made of a material that is more pliable than the electrical connector, making it easier for a lineperson to place the sleeve over an exposed portion of cable. The jacket sleeve can include holes or slots either in the sleeve or in tabs that are attached to the sleeve. A lineperson can place one or more fingers into each hole or slot in order to get a better grip on the sleeve and pull the sleeve over the exposed portion of cable with less slippage and effort on the part of the lineperson.

34 Claims, 6 Drawing Sheets

U.S. PATENT DOCUMENTS 3,594,685 A 7/1971 Cunningham
3,652,975 A 3/1972 Keto
3,654,590 A 4/1972 Brown
3,663,928 A 5/1972 Keto
3,670,287 A 6/1972 Keto
3,678,432 A 7/1972 Boliver
3,720,904 A 3/1973 De Sio
3,725,846 A * 4/1973 Strain ..... 439/89
3,740,503 A 6/1973 Tomohiro et al.
3,740,511 A 6/1973 Westmoreland
3,798,586 A 3/1974 Huska
3,826,860 A 7/1974 De Sio et al.
3,845,233 A 10/1974 Burton
3,860,322 A 1/1975 Sankey et al.
3,915,534 A 10/1975 Yonkers
3,924,914 A 12/1975 Banner
3,945,699 A 3/1976 Westrom
3,949,343 A 4/1976 Yonkers
3,953,099 A 4/1976 Wilson
3,955,874 A 5/1976 Boliver
3,957,332 A 5/1976 Lambert, III
3,960,433 A 6/1976 Boliver
4,029,380 A 6/1977 Yonkers
4,040,696 A * 8/1977 Wada et al. ..... 439/23
4,067,636 A 1/1978 Boliver et al.
4,088,383 A 5/1978 Fischer et al.
4,102,608 A 7/1978 Balkau et al.
4,103,123 A 7/1978 Marquardt
4,107,486 A 8/1978 Evnas
4,113,339 A 9/1978 Eley
4,123,131 A 10/1978 Pearce, Jr. et al.
4,152,643 A 5/1979 Schweitzer
4,154,993 A 5/1979 Kumbera et al.
4,161,012 A 7/1979 Cunningham
4,163,118 A 7/1979 Marien et al.
4,186,985 A 2/1980 Stepniak et al.
4,203,017 A 5/1980 Lee
4,210,381 A 7/1980 Borgstrom
4,223,179 A 9/1980 Lusk et al.
4,260,214 A 4/1981 Dorn
4,343,356 A 8/1982 Riggs et al.
4,353,611 A 10/1982 Siebens et al.
4,354,721 A 10/1982 Luzzi
4,360,967 A 11/1982 Luzzi et al.
4,443,054 A 4/1984 Ezawa et al.
4,463,227 A 7/1984 Dizon et al.
4,484,169 A 11/1984 Nishikawa
4,500,935 A 2/1985 Tsuruta et al.
4,508,413 A 4/1985 Bailey
4,568,804 A 2/1986 Luehring
4,600,260 A 7/1986 Stepniak et al.
4,626,755 A 12/1986 Butcher et al.
4,638,403 A 1/1987 Amano et al.
4,678,253 A 7/1987 Hicks et al.
4,688,013 A 8/1987 Nishikawa et al.
4,700,258 A 10/1987 Farmer
4,715,104 A * 12/1987 Schoenwetter et al. ..... 29/271
4,722,694 A 2/1988 Makal et al.
4,767,894 A 8/1988 Schombourg
4,767,941 A 8/1988 Brand et al.
4,779,341 A 10/1988 Roscizewski
4,793,637 A 12/1988 Laipply et al.
4,799,895 A 1/1989 Borgstrom
4,820,183 A 4/1989 Knapp et al.
4,822,291 A 4/1989 Cunningham
4,822,951 A 4/1989 Wilson et al.
4,834,677 A 5/1989 Archang
4,857,021 A 8/1989 Boliver et al.
4,863,392 A 9/1989 Borgstrom et al.
4,867,687 A 9/1989 Williams et al.
4,871,888 A 10/1989 Bestel
4,891,016 A 1/1990 Luzzi et al.
4,911,655 A 3/1990 Pinyan et al.
4,946,393 A 8/1990 Borgstrom
4,955,823 A 9/1990 Luzzi
4,972,049 A 11/1990 Muench
4,982,059 A 1/1991 Bestel
5,025,121 A 6/1991 Allen et al.
5,045,656 A 9/1991 Kojima
5,045,968 A 9/1991 Suzuyama et al.
5,053,584 A 10/1991 Chojnowski
5,101,080 A 3/1992 Ferenc
5,114,357 A 5/1992 Luzzi
5,128,824 A 7/1992 Yaworski et al.
5,130,495 A 7/1992 Thompson
5,132,495 A * 7/1992 Ewing et al. ..... 174/138 F
5,166,861 A 11/1992 Krom
5,175,403 A 12/1992 Hamm et al.
5,213,517 A 5/1993 Kerek et al.
5,221,220 A 6/1993 Roscizewski
5,230,142 A 7/1993 Roscizewski
5,230,640 A 7/1993 Tardif
5,248,263 A 9/1993 Sakurai et al.
5,266,041 A 11/1993 De Luca
5,277,605 A 1/1994 Roscizewski et al.
5,356,304 A 10/1994 Colleran
5,358,420 A 10/1994 Cairns et al.
5,359,163 A 10/1994 Woodard
5,393,240 A 2/1995 Makal et al.
5,422,440 A 6/1995 Palma
5,427,538 A 6/1995 Knapp et al.
5,429,519 A 7/1995 Murakami et al.
5,433,622 A 7/1995 Galambos
5,435,747 A 7/1995 Franckx et al.
5,445,533 A 8/1995 Roscizewski et al.
5,468,164 A 11/1995 Demissy
5,492,487 A 2/1996 Cairns et al.
5,525,069 A 6/1996 Roscizewski et al.
5,589,671 A 12/1996 Hackbarth et al.
5,619,021 A 4/1997 Yamamoto et al.
5,641,310 A 6/1997 Tiberio, Jr.
5,655,921 A 8/1997 Makal
5,661,280 A 8/1997 Kuss et al.
5,667,060 A 9/1997 Luzzi
5,717,185 A 2/1998 Smith
5,736,705 A 4/1998 Bestel et al.
5,737,874 A 4/1998 Sipos et al.
5,747,765 A 5/1998 Bestel et al.
5,747,766 A 5/1998 Waino et al.
5,757,260 A 5/1998 Smith et al.
5,766,030 A 6/1998 Suzuki
5,766,517 A 6/1998 Goedde et al.
5,795,180 A 8/1998 Siebens
5,808,258 A 9/1998 Luzzi
5,816,835 A 10/1998 Meszaros
5,846,093 A 12/1998 Muench et al.
5,857,862 A 1/1999 Muench et al.
5,864,942 A 2/1999 Luzzi
5,886,294 A * 3/1999 Scrimpshire et al. ..... 174/359
5,912,604 A 6/1999 Harvey et al.
5,917,167 A 6/1999 Bestel
5,936,825 A 8/1999 DuPont
5,949,641 A 9/1999 Walker et al.
5,953,193 A 9/1999 Ryan
5,957,712 A 9/1999 Stepniak
6,022,247 A 2/2000 Akiyama et al.
6,040,538 A 3/2000 French et al.
6,042,407 A 3/2000 Scull et al.
6,069,321 A 5/2000 Wagener et al.
6,130,394 A 10/2000 Hogl
6,168,447 B1 1/2001 Stepniak et al.
6,205,029 B1 3/2001 Byre et al.
6,213,799 B1 4/2001 Jazowski et al.
6,220,888 B1 4/2001 Correa

| | | | | |
|---|---|---|---|---|
| 6,227,908 | B1 | 5/2001 | Aumeier | |
| 6,250,950 | B1 | 6/2001 | Pallai | |
| 6,280,659 | B1 | 8/2001 | Sundin | |
| 6,332,785 | B1 | 12/2001 | Muench, Jr. et al. | |
| 6,338,637 | B1 | 1/2002 | Muench, Jr. et al. | |
| 6,362,445 | B1 | 3/2002 | Mearchland et al. | |
| 6,364,216 | B1 | 4/2002 | Martin | |
| 6,416,338 | B1 | 7/2002 | Berlovan | |
| 6,429,373 | B1 * | 8/2002 | Scrimpshire et al. | 174/74 R |
| 6,453,776 | B1 | 9/2002 | Beattie et al. | |
| 6,504,103 | B1 | 1/2003 | Meyer et al. | |
| 6,517,366 | B2 | 2/2003 | Bertini et al. | |
| 6,520,795 | B1 | 2/2003 | Jazowski | |
| 6,538,312 | B1 | 3/2003 | Peterson et al. | |
| 6,542,056 | B2 | 4/2003 | Nerstron et al. | |
| 6,566,996 | B1 | 5/2003 | Douglass et al. | |
| 6,585,531 | B1 | 7/2003 | Stepniak et al. | |
| 6,664,478 | B2 | 12/2003 | Mohan et al. | |
| 6,674,159 | B1 | 1/2004 | Peterson et al. | |
| 6,689,947 | B2 | 2/2004 | Ludwig | |
| 6,705,898 | B2 | 3/2004 | Pechstein et al. | |
| 6,709,294 | B1 | 3/2004 | Cohen et al. | |
| 6,733,322 | B2 | 5/2004 | Boemmel et al. | |
| 6,744,255 | B1 | 6/2004 | Steinbrecher et al. | |
| 6,790,063 | B2 | 9/2004 | Jazowski et al. | |
| 6,796,820 | B2 | 9/2004 | Jazowski et al. | |
| 6,809,413 | B1 | 10/2004 | Peterson et al. | |
| 6,811,418 | B2 | 11/2004 | Jazowski et al. | |
| 6,830,475 | B2 | 12/2004 | Jazowski et al. | |
| 6,843,685 | B1 | 1/2005 | Borgstrom et al. | |
| 6,888,086 | B2 | 5/2005 | Daharsh et al. | |
| 6,905,356 | B2 | 6/2005 | Jazowski et al. | |
| 6,936,947 | B1 | 8/2005 | Leijon et al. | |
| 6,939,151 | B2 | 9/2005 | Borgstrom et al. | |
| 6,972,378 | B2 | 12/2005 | Schomer et al. | |
| 6,984,791 | B1 * | 1/2006 | Meyer et al. | 174/167 |
| 7,018,236 | B2 | 3/2006 | Nishio et al. | |
| 7,019,606 | B2 | 3/2006 | Williams et al. | |
| 7,044,760 | B2 | 5/2006 | Borgstrom et al. | |
| 7,044,769 | B2 | 5/2006 | Zhao et al. | |
| 7,050,278 | B2 | 5/2006 | Poulsen | |
| 7,059,879 | B2 | 6/2006 | Krause et al. | |
| 7,077,672 | B2 | 7/2006 | Krause et al. | |
| 7,079,367 | B1 | 7/2006 | Liljestrand | |
| 7,083,450 | B1 | 8/2006 | Hughes | |
| 7,104,822 | B2 | 9/2006 | Jazowski et al. | |
| 7,104,823 | B2 | 9/2006 | Jazowski et al. | |
| 7,108,568 | B2 * | 9/2006 | Jazowski et al. | 439/801 |
| 7,134,889 | B2 | 11/2006 | Hughes et al. | |
| 7,150,098 | B2 | 12/2006 | Borgstrom et al. | |
| 7,168,983 | B2 | 1/2007 | Graf et al. | |
| 7,170,004 | B2 | 1/2007 | Gramespacher et al. | |
| 7,182,647 | B2 | 2/2007 | Muench et al. | |
| 7,212,389 | B2 | 5/2007 | Hughes | |
| 7,216,426 | B2 | 5/2007 | Borgstrom et al. | |
| 7,234,980 | B2 | 6/2007 | Jazowski et al. | |
| 7,241,163 | B1 * | 7/2007 | Cox et al. | 439/445 |
| 7,247,061 | B2 | 7/2007 | Hoxha et al. | |
| 7,247,266 | B2 | 7/2007 | Bolcar | |
| 7,258,585 | B2 | 8/2007 | Hughes et al. | |
| 7,278,889 | B2 | 10/2007 | Muench et al. | |
| 7,341,468 | B2 | 3/2008 | Hughes et al. | |
| 2001/0008810 | A1 | 7/2001 | George et al. | |
| 2002/0055290 | A1 | 5/2002 | Jazowski et al. | |
| 2003/0228779 | A1 | 12/2003 | Jazowski et al. | |
| 2004/0121657 | A1 | 6/2004 | Muench et al. | |
| 2005/0208808 | A1 | 9/2005 | Jazowski et al. | |
| 2005/0212629 | A1 | 9/2005 | Williams et al. | |
| 2005/0260876 | A1 | 11/2005 | Krause et al. | |
| 2006/0110983 | A1 | 5/2006 | Muench et al. | |
| 2006/0160388 | A1 | 7/2006 | Hughes et al. | |
| 2006/0216992 | A1 | 9/2006 | Hughes et al. | |
| 2007/0026713 | A1 | 2/2007 | Hughes et al. | |
| 2007/0026714 | A1 | 2/2007 | Hughes et al. | |
| 2007/0032110 | A1 | 2/2007 | Hughes et al. | |

FOREIGN PATENT DOCUMENTS

| | | |
|---|---|---|
| DE | 3521365 | 2/1987 |
| DE | 19906972 A1 | 2/1999 |
| EP | 0624940 | 11/1994 |
| EP | 0782162 A2 | 7/1997 |
| EP | 0957496 | 11/1999 |
| FR | 2508729 | 12/1982 |
| GB | 105227 | 2/1918 |
| GB | 2254493 | 10/1992 |
| JP | S62-198677 | 12/1987 |
| JP | S63-93081 | 6/1988 |
| JP | H1-175181 | 7/1989 |
| JP | H3-88279 | 9/1991 |
| JP | H4-54164 | 5/1992 |
| WO | WO 00/41199 | 7/2000 |

OTHER PUBLICATIONS

U.S. Appl. No. 11/738,948, Hughes et al.
U.S. Appl. No. 11/738,941, Hughes et al.
U.S. Appl. No. 11/688,673, Hughes et al.
U.S. Appl. No. 11/688,648, Hughes et al.
U.S. Appl. No. 11/677,703, Hughes et al.
U.S. Appl. No. 11/676,861, Hughes et al.
Loadbreak Apparatus Connectors Service Information 500-26, Cooper Power Systems, May 2003, Waukesha, WI.
Deadbreak Apparatus Connectors Electrical Apparatus, Cooper Power Systems, Jul. 1999, Marketing Material.
Link-Op 600A Operable Connector System, Marketing Material.
Installation Instructions, 650LK-B Link Operable Connector System (Bolted) May 1, 1989.
G&W Electric Co.; "Breakthrough in Switching Technology; Solid Dielectric Switchgear"; Oct. 2001; Blue Island, IL. cited by other .
Cooper Power Systems; "Padmounted Switchgear; Type RVAC, Vacuum-Break Switch, Oil-Insulated or SF.sub.6-Insulated; Electrical Apparatus 285-50"; Jul. 1998. cited by other.
Cooper Power Systems; "Padmounted Switchgear; Type MOST Oil Switch; Electrical Apparatus 285-20"; Jul. 1998. cited by other.
Cooper Power Systems; "Molded Rubber Products; 600 A 35 kV Class Bol-T.TM. Deadbreak Connector; Electrical Apparatus 600-50"; Jan. 1990. cited by other.
Cooper Power Systems; "Padmounted Switchgear; Kyle.RTM. Type VFI Vacuum Fault Interrupter; Electrical Apparatus 285-10", Jan. 1998. cited by other.
"Loadbreak Appatus Connectors, 200 A 25kV Class—Expanded Range Loadbreak Elbow Connector, Electrical Apparatus 500-28"; Cooper Power Systems; pp. 1-4; (Jan. 2004). cited by other.
Kevin Fox, "The Cooper Posi-Break.TM. Solution to Separable Connector Switching Problems at Wisconsin Electric Power Company," Component Products, Bulletin No. 98065, copyright 1998 Cooper Power Systems, MI Oct. 1998 5M, 2 total pages. cited by other.
"The Cooper Posi-Break.TM., Elbow and Cap, Engineered Solution Increases Strike Distance and Improves Reliability," copyright 1998 Cooper Power Systems, Inc., Bulletin 98014, MI 398/15M, 6 total pages. cited by other.
Loadbreak Apparatus Connectors, "200 A 25 kV Class Loadbreak Bushing Insert," Service Information 500-26, Cooper Power Systems, May 2003, pp. 1-2. cited by other.
Loadbreak Apparatus Connectors, "200 A kV Class Cooper Posi-Break.TM. Expanded Range Loadbreak Elbow Connector," Service Information 500-29, Cooper Power Systems, Jan. 2004, pp. 1-4. cited by other.
Product Brief, "Latched Elbow Indicator," Cooper Power Systems, Bulletin 94014, Apr. 1994, 1 total page. cited by other.
"Stick-OPerable 600-Amp Connector Systems," *Elastimold, Amerace Corporation*, Feb. 1984, 11 pages.
"Molded Rubber Products, 600 A 15 kV Class T-OP™ II Deadbreak Connector Electrical Apparatus 600-12," *Cooper Power Systems*, Jul. 2005, pp. 1-4.

"Molded Rubber Products, 600 A 15 and 25 kV Deadbreak Accessories, Tools, Replacement Parts Electrical Apparatus 600-46"; *Cooper Power Systems*, Jul. 1997, pp. 1-4.
"Molded Rubber Products, 600 A 25 kV Class BT-TAP™ Deadbreak Connector Electrical Apparatus, 600-35," *Cooper Power Systems*, Mar. 2003, pp. 1-5.
"Deadbreak Apparatus Connectors, 600 A 15/25 kV Class Bol-T™ Deadbreak Connector Electrical Apparatus 600-10," *Cooper Power Systems*, Aug. 2002, 6 pages.
"Deadbreak Apparatus Connector, 600 A 25 kV Class Bushing Adapter for T-OP™ Connector Systems (including LRTP and Bushing Extender) Electrical Apparatus 600-38," *Cooper Power Systems*, Jun. 1997, pp. 1-4.
"Loadbreak Apparatus Connectors, 200 A 15 kV Class Loadbreak Bushing Insert 500-12," *Cooper Power Systems*, Nov. 1995, pp. 1-2.
"T-OP™ II: How Many Sticks Does It Take To Operate Your 600 Amp Terminator System?," *Cooper Power Systems*, Jul. 1994, 4 pages.
"Installation & Operation Instructions 168ALR, Access Port Loadbreak Elbow Connectors"; *Elastimold IS-168ALR* (*Rev C*); pp. 1-5; (Feb. 1, 1994).
"Operating Instructions 200TC-2"; *Elastimold IS-200TC* (*Rev-A*); pp. 1-2; (Feb. 26, 1995).
"Surge Arresters"; *Elastimold Catalog*; pp. 26-27; (2001).
"Surge Arresters, Metal Oxide Varistor elbow (M.O.V.E.™) Surge Arrester Electrical Apparatus 235-65"; *Cooper Power Systems*; pp. 1-4; Dec. 2003.
"Surge Arresters, Metal Oxide Elbow Surge Arrester Electrical Apparatus 235-65"; *Cooper Power Systems*; pp. 1-4; Jan. 1991.
"Surge Arresters, Metal Oxide Varistor (MOV) Parking Stand Surge Arrester Electrical Apparatus 235-68"; *Cooper Power Systems*; pp. 1-3; Apr. 2002.
"INJPLUG35, 35 kV Amp Loadbreak Injection Plug Operating and Installation Instructions"; *Cooper Power Systems*; p. 1; (Sep. 2002).
"Loadbreak Apparatus Connectors, 200 A 15 kV Class Loadbreak Elbow Connector, Electrical Apparatus 500-10"; *Cooper Power Systems*; pp. 1-4; (Feb. 2004).
"Loadbreak Apparatus Connectors, 200 A 15 kV and 25 kV Class Elbow Installation Instructions, Service Information S500-10-1"; *Cooper Power Systems*; pp. 1-4; (Feb. 2001).
"Loadbreak Apparatus Connectors, 200 A 15kV Class Loadbreak Bushing Insert 500-12"; *Cooper Power Systems*; pp. 1-2; (Nov. 1995).
"Loadbreak Apparatus Connectors, 200 A 15kV Class Loadbreak Rotatable Feedthru Insert; Electrical Apparatus 500-13"; *Cooper Power Systems*; pp. 1-2; (Apr. 2001).
"Loadbreak Apparatus Connectors, 200 A 25 kV Class—Expanded Range Loadbreak Elbow Connector, Electrical Apparatus 500-28"; *Cooper Power Systems*; pp. 1-4; (Jan. 2004).
"Loadbreak Apparatus Connectors, 200 A 25 kV Class Rotatable Feedthru Insert, Electrical Apparatus 500-30"; *Cooper Power Systems*; pp. 1-2; (Jun. 1999).
"Loadbreak Apparatus Connectors, 200 A 35 kV Class Three-Phase Loadbreak Injection Elbow Installation Instructions, Service Information S500-55-2"; *Cooper Power Systems*; pp. 1-6; (Apr. 1999).
Cooper Power Systems, *Deadbreak Apparatus Connectors*, "600 A 15/25 kV Clas Bol-T™ Deadbreak Connector", Electrical Apparatus 600-30, pp. 1-6, Feb. 2003.
Cooper Power Systems, *Deadbreak Apparatus Connectors*, "600 A 15/25 kV Class PUSH-OP® Deadbreak Connector", Electrical Apparatus 600-33, pp. 1-4, Nov. 2004.
Cooper Power systems, *Molded Rubber Products*, "600 A 15/25 kV Class T-OP™ II Deadbreak Connector", Electrical Apparatus 600-32, pp. 1-4, Jul. 2005.
Cooper Power Systems, *OEM Equipment*, "Four-Position Sectionalizing Loadbreak Switches", Electrical Apparatus 800-64, pp. 1-8, Dec. 2003.

* cited by examiner

JACKET SLEEVE WITH GRIPPABLE TABS FOR A CABLE CONNECTOR

FIELD OF THE INVENTION

The present invention relates generally to the field of power distribution equipment. More particularly, the invention relates to jacket sleeves used with cable and connectors for power distribution equipment.

BACKGROUND OF THE INVENTION

Separable connectors are typically employed to interconnect sources of energy, such as electrical distribution network conductors, to localized distribution components, such as switchgears and transformers. These connectors, for example, typically include a bushing insert, which is mounted in the bushing well of the switchgear, and an elbow connector which is releasably connected to the bushing insert on one end and a distribution conductor, such as a high voltage cable, of the network circuit feeding the switchgear. When the elbow is interconnected to the bushing, the switchgear is thus interconnected into the distribution network and thereby energized. Likewise, if the elbow is removed, the switchgear is disconnected from the distribution network and the switchgear is de-energized.

As part of the connection process, the elbow connectors are typically attached to an above ground or underground power cable. In order to attach the cable to the elbow connector, the protective layers of the cable, including the concentric neutrals that provide a path of return for the electrons in an alternating current system, must be removed, or peeled back, from a portion of the cable so that the conductor portion of the cable may be attached to the elbow connector. While a portion of the exposed cable is positioned within the elbow connector, another portion of the exposed cable is left outside of the elbow connector and could be exposed to the elements. The concentric neutrals are particularly at risk and tend to decay rapidly when exposed to moisture. Moisture causes the concentric neutrals to oxidize and corrode. After a certain level of corrosion has built up, the cable needs to be replaced because the return path for the electrons has been permanently disrupted. While the exposed portions of the cable are at risk for decay and damage due to exposure to water and other elements, unexposed portions of the cable are also at risk. For example, water that reaches and contacts the concentric neutrals of the exposed portion of the cable can be wicked away from the point of contact to other areas miles away from the exposed portion of the cable, causing corrosion and failure of the concentric neutrals along long sections of cable.

In order to protect the cable at the connection point with the elbow and other connectors, cable jacket sleeves were created. The cable jacket sleeves had a generally hollow cylindrical shapeand came in three primary varieties: pre-molded slide-on, heat shrink, and cold shrinkable. Heat shrink sleeves were placed over the exposed portion of the cable as described below. The lineperson would then use a blowtorch or other heat source to shrink the sleeve around the exposed portion of the cable to create a tighter seal.

Cold shrinkable sleeves are pre-expanded and placed onto a removable core. After the cold shrinkable sleeve is placed over the cable joint, the core is removed and the sleeve shrinks back to its original size, sealing the joint. Pre-molded slide-on sleeves have typically have to be lubricated to reduce the friction created by the tight interference fit required to seal the joint and are manually pushed or pulled onto the cable by a lineperson. Pre-molded slide-on sleeves generally require more steps and force to install, but are simpler and cheaper to manufacture than the other sleeve varieties.

Pre-molded slide-on jacket sleeves required a lineperson to place the seal on the cable prior to attaching the elbow connector. Once the elbow connector was attached to the cable, mastic and/or electrical tape was placed over the exposed portion of the cable and the jacket sleeve had to be pulled back up the cable and across the mastic until it covered the exposed portion of the cable and a portion of the elbow connector. Small tabs were added along both ends of some of the pre-molded slide-on sleeves to assist a lineperson in pulling the sleeve up and down the cable body. When completing the attachment of several connectors to cables, the multiple steps of pulling the sleeve down onto the cable and then pulling it back up the cable once the elbow connector was attached greatly increased the time and effort needed to properly protect the cable.

In order to reduce the time necessary to attach a cable to an elbow connector and properly protect the exposed portions of the cable with a sleeve, and to reduce the overall cost of the sleeve and elbow connector, a conventional combination sleeve and elbow connector has been created. The combination creates an integral jacket sleeve along the portion of the elbow connector to which the cable is attached. The combination is made by molding the elbow connector and the jacket sleeve together, at the same time and from the same material, thereby reducing cost and manufacturing time. In addition, since the jacket sleeve is integrally built into the elbow connection, once a lineperson has attached a cable, he or she need only pull the jacket sleeve in one direction, down over the exposed portion of the cable. In order to assist the lineperson in grasping and pulling the cable, two small tabs have been added to and extend longitudinally from the jacket sleeve.

Unfortunately, the combination jacket sleeve and elbow connector has several drawbacks. First, the exterior of most elbow connectors is made of a conductive or semi-conductive rubber so that the elbow connector can drain off a charge and be at ground potential. The rubber is made conductive by adding carbon black to it. One side effect of adding carbon black to rubber is that it makes the rubber extremely stiff. This side effect is beneficial for the elbow connector because it provides added strength to the elbow connector thereby reducing cracking or tearing along the pulling eye and other stress points of the elbow connector when the connector is being attached or detached from the bushing. By making the jacket sleeve from the same material the jacket sleeve is stiff and not pliable. The stiffer jacket sleeve is difficult to get over the exposed portion of the cable, once mastic and/or tape has been applied because the sleeve does not stretch well but still must have an interference fit with the tape or mastic covering the exposed portion of the cable.

Another problem with the combination jacket sleeve and elbow connector is that the small tabs provided along the edge of the jacket sleeve are not sufficient to assist in grasping and pulling the jacket sleeve over the tape and mastic. When connecting cable to the elbow connectors and the elbow connectors to the switchgear or transformer, a lineperson must apply layers of grease to each of the connecting bodies. As a function of the application, a lineperson frequently gets grease on their hands, making it difficult to grasp and hold onto the small tabs provided on the jacket sleeve.

Yet another problem with the combination jacket sleeve and elbow connector is that, the window for error in building up the protective layers of tape and mastic on the exposed portion of the cable is substantially less with the stiffer material being used for the jacket sleeve. Mastic is a gooey adhesive (and in some forms a tape), similar to putty, that bonds to itself and provides a water barrier for the exposed portion of the cable. Unfortunately, mastic tends to become loose and runny under extreme heat and comes off of the cable if it is not held in place. Therefore, electrical tape is typically applied over the mastic in several layers to hold the mastic in place and provide compression. The jacket sleeve generally has an inside diameter that is greater than the cable so that the layer of mastic and tape may be applied and an interference fit with the tape can be created. However, the stiffer the sleeve is, the less a lineperson will be able to get the sleeve over tape that has a diameter that is a little too large.

In view of the foregoing there is a need in the art for a jacket sleeve that may be made integrally with or subsequently affixed to a connector, whereby the jacket sleeve is made of a material that is more pliable than the connector. Furthermore, there is a need in the art for a jacket sleeve that provides an improved method for grasping and pulling the sleeve over the tape, mastic and exposed portions of the cable. Furthermore there is a need in the art for a method of manufacturing a jacket sleeve either integrally or separate from an electrical connector whereby the sleeve is made of a material that is more pliable than the material from which the electrical connector is made.

SUMMARY OF THE INVENTION

A jacket sleeve with grippable tabs provides protection to exposed portions of cable that are connected to an electrical connection. The jacket sleeve can be made as part of the electrical connector or may be connected subsequent to its creation through the use of glues or other adhesives. The jacket sleeve can be made of a material that is more pliable than the electrical connector, making it easier for a lineperson to place the sleeve over an exposed portion of cable. The jacket sleeve can also include holes or slots either in the sleeve or in tabs that are attached to the sleeve. A lineperson can place one or more fingers, which may include the thumb, into each hole or slot in order to get a better grip on the sleeve and pull the sleeve over the exposed portion of cable with less slippage and less effort on the part of the lineperson.

For one aspect of the present invention, a jacket sleeve for a cable connector can include an elongated body made of a pliable material, such as rubber. The body can be hollow and have a generally tubular shape. Each end of the tubular body can include openings that create a channel through the body. The tubular body can also include multiple holes or slots. These holes or slots are generally positioned near one of the ends of the housing along the external side of the tubular body. Each hole or slot generally creates an area in the tubular body for grasping and pulling the jacket sleeve onto or off of a cable.

For yet another aspect of the present invention, a jacket sleeve for a cable connector can include an elongated housing made of a pliable material, such as rubber. The housing can include a hollow body having a generally tubular shape. Each end of the tubular body can include openings that create a channel through the body. The jacket sleeve can also include two or more pull tabs attached to one end of the tubular body. Each tab can include a hole or slot. Each hole or slot is generally positioned along the external side of the tab. Each hole or slot generally presents an area in the tab for grasping and pulling the jacket sleeve onto or off of a cable.

For still another aspect of the present invention, an electrical connector can include a connector body made up of an insulated housing and a channel through at least a portion of the insulated housing. The channel defines an area for receiving an electrical cable. The connector body can also include a opening along one end of the channel that acts as the entry point for the electrical cable into the connector body. The electrical connector can further include an elongated jacket sleeve made of a pliable material, such as an EPDM (ethylene-propylene-dienemonomer) or silicone elastomer. The sleeve can include a hollow body having a generally tubular shape. Each end of the tubular body can include openings that create a channel through the body. The jacket sleeve can also include two or more pull tabs attached to one end of the tubular body. Each tab can include a hole or slot. Each hole or slot is generally positioned along the external side of the tab. Each hole or slot generally presents an area in the tab for grasping and pulling the jacket sleeve onto or off of a cable. Another end of the jacket sleeve can be coupled to the insulated housing of the connector body at a point near one end of the channel.

For yet another aspect of the present invention, a method of making an electrical connector can include molding a connector body having the features described hereinabove. A jacket sleeve having features described hereinabove can be molded. One end of the jacket sleeve can then be coupled to the insulated housing of the connector body along an area adjacent to the opening for the first end of the channel. The coupling can be achieved using an adhesive.

For another aspect of the present invention, a method of making an electrical connector can include molding a connector body having the features described hereinabove. The connector body may be allowed to cure and can then be placed into a second mold. In the second mold, a jacket sleeve having the features described hereinabove can be overmolded onto the connector body. The overmolded material cures and cross-links with the connector body creating a strong, permanent chemical bond.

For still another aspect of the present invention, a method of making an electrical connector can include preparing a mold for the creation of the electrical connector and jacket sleeve combination. A first material can be injected into a first portion of the mold. A second material can simultaneously be injected into a second portion of the mold. The first portion of the mold generally has the shape of the connector body described herein and will be substantially filled with the first material. The second portion of the mold generally has the shape of the jacket sleeve and will be substantially filled with the second material.

BRIEF DESCRIPTION OF DRAWINGS

For a more complete understanding of the exemplary embodiments of the present invention and the advantages thereof, reference is now made to the following description in conjunction with the accompanying drawings in which.

DETAILED DESCRIPTION OF THE EXEMPLARY EMBODIMENTS

The present invention is directed to a jacket sleeve for an electrical connector and methods for making the same. Exemplary embodiments of the invention can be more readily understood by reference to the accompanying figures.

Exemplary embodiments of the present invention include a jacket sleeve for receiving therethrough and protecting a high voltage cable in a power distribution environment. However, it should be apparent that there could be many different ways of implementing the invention in an electrical environment, and the invention should not be construed as limited to a high voltage environment or any one set of features or methods described herein. The inventive functionality of the jacket sleeve with grippable tabs will be explained in more detail in the following description and is disclosed in conjunction with the remaining figures.

Figure 1:
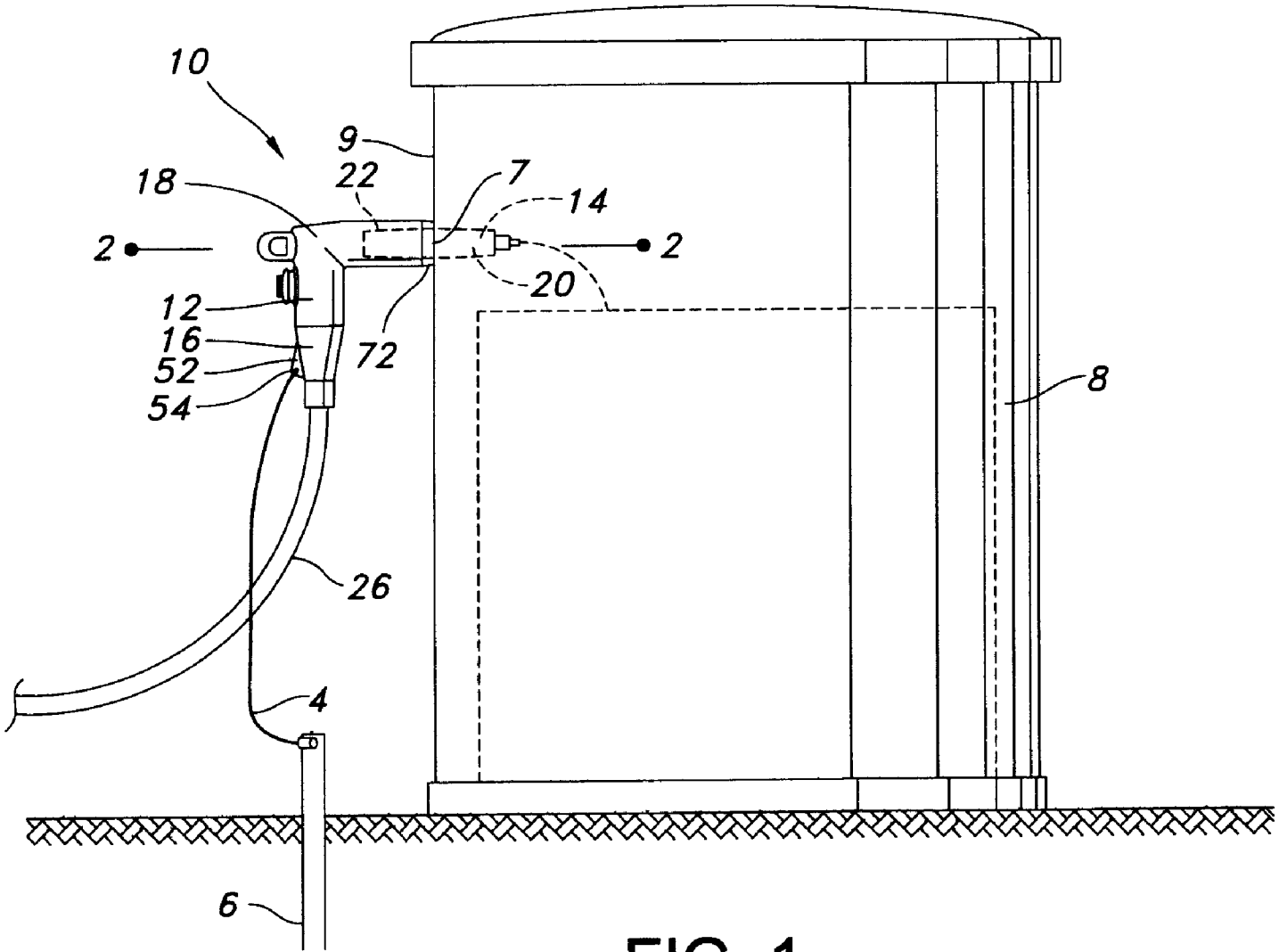
FIG. 1 is an elevational view, partly in cross-section, of a loadbreak connector installed on a switchgear enclosure in accordance with one exemplary embodiment of the present invention.

Referring now to the drawings in which like numerals represent like elements throughout the several figures, aspects of the present invention will be described. FIG. 1, shows a connection between a loadbreak connector and a switchgear, in accordance with exemplary embodiments of the present invention. In FIG. 1, the loadbreak connector 10 can be installed on a switchgear enclosure 9. The switchgear enclosure 9 typically includes the operative components of a switchgear 8. The exact type and arrangement of components can vary greatly depending on the use of the switchgear 8. The general components and the types of arrangements of switchgear 8 are well known to those of ordinary skill in the art and will not be discussed herein. In an alternative embodiment, the loadbreak connector 10 may be installed on a transformer tank (not shown) in which a transformer is located.

The loadbreak connector 10 generally includes a bushing 14 and an elbow connector 12, which is integrally connectable over the bushing 14. The elbow connector 12 includes an insulated conductor receiving portion 16 which can receive a high voltage conductor or cable 26 therein, and a substantially right-angled probe retainer portion 18. The exterior conductive surface of the elbow connector 12 is interconnected to ground 6 through a ground strap 4 interconnected to a grounding aperture, or hole, 54 in a grounding tab 52. This ensures that the outer surface of the elbow connector 12 remains at ground potential. The bushing 14 is installed through a hole, or aperture, 7 in the wall of the switchgear enclosure wall 9 and is electrically connected to the switchgear 8. The bushing 14 includes an internal shank end 20 and a probe receiving portion 22 forming opposite ends of the bushing 14 separated by a flange 72. The probe receiving portion 22 of the bushing 14 is received within a probe retainer portion 18 of the elbow connector 12 upon interconnection thereof.

Figure 2:
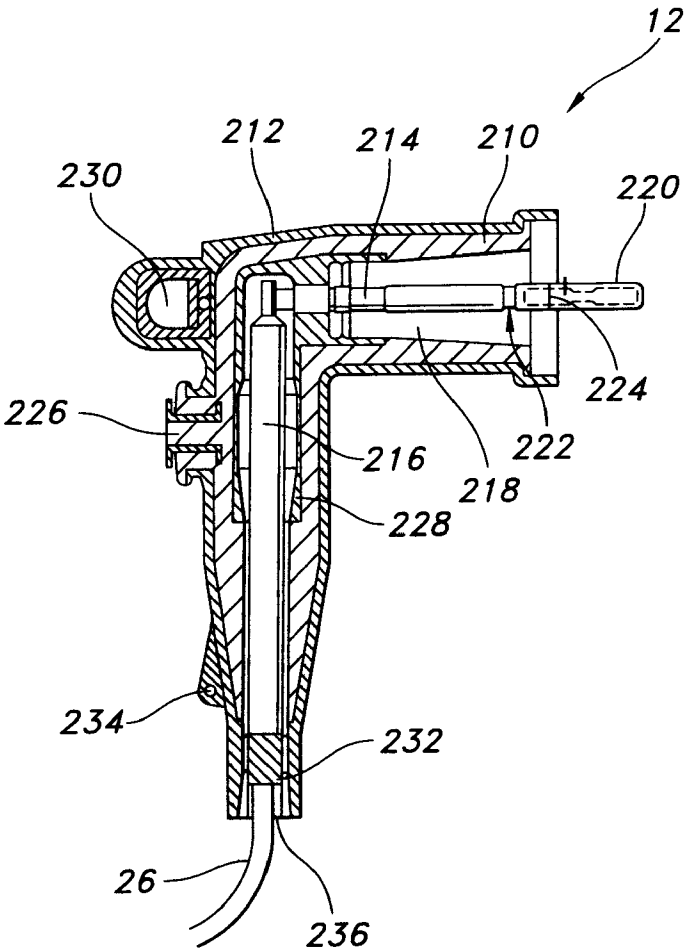
FIG. 2 is a longitudinal cross-sectional view of a separable loadbreak connector elbow in accordance with one exemplary embodiment of the present invention.

FIG. 2 is a longitudinal cross-sectional view of a conventional separable loadbreak connector elbow connector 12 that may be utilized to connect and disconnect cables 26 to the switchgear 8 under energized circuit conditions at rated voltage and under electrical load current conditions in accordance with certain exemplary embodiments of the present invention. Referring now to FIGS. 1 and 2, the exemplary loadbreak connector bushing 14 includes a male connector elbow connector 12. The elbow connector 12, may be, for example, an elbow connector, electrically connected to a respective one of the cables 26 (FIG. 1). The exemplary elbow connector 12 respectively engages and disengages, for example, a female connector or bushing (not shown) to achieve electrical connection or disconnection to and from the switchgear 8 or other electrical apparatus.

While the elbow connector 12 is presented as having a representative elbow-like design in FIG. 2, the elbow connector 12 may be of other types and configurations known to those of ordinary skill in the art. In an exemplary embodiment, and as shown in FIG. 2, the elbow connector 12 may include an elastomeric housing 210 of a material such as EPDM rubber which is provided on its outer surface with a conductive shield layer 212 which can be connected to electrical ground 6. One end of a male contact element or probe 214, which may be constructed from a material such as copper, extends from a conductor contact 216 within the housing 210 into a cup shaped recess 218 of the housing 210. While the probe 214 and other conductive elements are described herein as being comprised of copper, those or ordinary skill in the art will recognize that many other metallic and non-metallic conductive materials may be used in place of copper within the scope of the present invention.

An arc follower 220 constructed from ablative material extends from an opposite end of the probe 214. In one example, the arc follower 220 may be constructed from acetal co-polymer resin loaded with finely divided melamine. The ablative material may be injection molded on an epoxy bonded glass fiber reinforcing pin 222. A recess 224 is provided at the junction between the probe 214 and the arc follower 220. An aperture (not shown) is provided through the exposed end of the probe 214 for the purpose of assembly.

The elbow connector 12 may further include capacitive test aperture 226. The test aperture 226 provides a shielded, hot-stick-operable means to determine circuit condition when used with high impedance voltage sensing devices known to those of ordinary skill in the art (not shown). The test aperture 226 can include a cap (not shown) that is capable of being snapped into and covering the aperture 226 and thereby preventing access to the aperture 226 from a position external to the elbow connector 12. The elbow connector 12 may further include a semi-conductive insert 228, positioned such that it surrounds a portion of the conductor contact 216 and the cup-shaped recess 218 substantially near the point of interaction between the conductor contact 216 and the probe 214. The semi-conductive insert 228 controls electrical stress within the elbow connector 12. In one exemplary embodiment, the semi-conductive insert 228 is made of a molded peroxide cured EPDM.

The elbow connector 12 further includes a pulling eye 230. The pulling eye 230 is positioned substantially in line with the longitudinal axis of the probe 214 and opposite the opening of the cup-shaped recess 218. The pulling eye 230 provides a point of attachment for a hotstick or other device to engage or disengage the elbow connector 12 from the switchgear 8 or other electrical device. In one exemplary embodiment, the pulling eye 230 is composed of stainless steel, however other metallic and non-metallic elements known to those or ordinary skill in the art may be employed in place of stainless steel. The external surface of the pulling eye 230 is typically surrounded by the conductive shield layer 212.

The elbow connector 12 can further include a compression connector 232 coupled to and positioned along and affixed to one end of the conductor contact 216. The opposing end of the compression connector 232 is capable of slidably receiving and being affixed to a cable 26, to provide electrical communication and transmission between the cable 26 and the conductor contact 216. Those of ordinary skill in the art will recognize that the present invention is not limited to the use of compression connectors 232 within the elbow connector 12 and that other types of cable connectors known to those of ordinary skill in the art may be used within the scope of the invention. The elbow connector 12 further includes a grounding eye 234 that can be molded into or affixed to the semiconductive shield 212 along the exterior of the elbow connector 12. The grounding eye 234 is capable of receiving and being connected to a drain wire (not shown), typically made of copper or other metallic material, to ensure deadfront construction.

The elbow connector 12 also includes a cable receiving aperture 236 positioned along one end of the conductor contact 216. In one exemplary embodiment, the aperture 236 has a substantially cylindrical shape and has an inner diameter that is dependent on the size of the cable 26 that the aperture 236 is intended to receive. One end of the cable 26 may be slidably inserted into the aperture 236 until it abuts and is connected to the compression connector 232.

The elbow connector 12 is operable or matable to a female connector during "loadmake", "loadbreak", and "fault closure" conditions. Loadmake conditions occur when one of the contact elements, such as the probe 214, is energized and the other contact element, such as a female contact element (not shown), is engaged with a normal load. An arc of moderate intensity is struck between the contact elements as they approach one another and until joinder under loadmake conditions. Loadbreak conditions occur when the mated probe 214 and female contact element (not shown) are separated when energized and supplying power to a normal load. Moderate intensity arcing again occurs between the contact elements from the point of separation thereof until they are sufficiently removed from one another. Fault closure conditions occur when the probe 214 and female contact element are mated, with one of them being energized and the other being engaged with a load having a fault, such as a short circuit condition. Substantial arcing occurs between the contact elements in fault closure conditions as the contact elements approach one another and are joined. In accordance with known types of loadbreak connectors, expanding gas is employed to accelerate the female contact in the direction of the probe 214 as the elbow connector 12 and female connector are engaged, thus minimizing arcing time and hazardous conditions.

Figure 3:
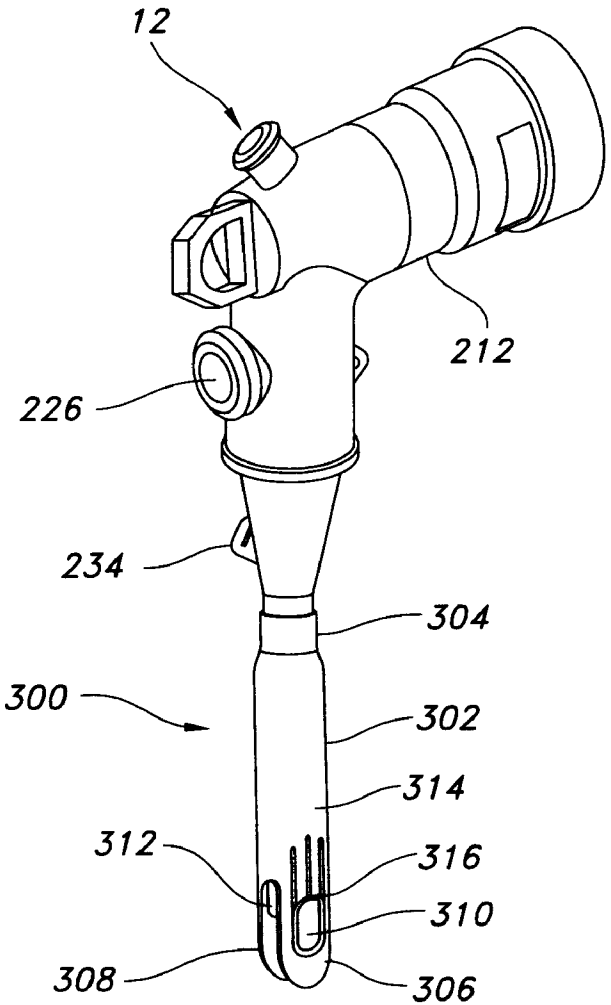
FIG. 3 is a perspective view of a jacket sleeve in an extended orientation and connected to the exemplary loadbreak connector in accordance with one exemplary embodiment of the present invention.

FIG. 3 is a perspective view of an elbow connector 12 and jacket sleeve 300 in an extended orientation in accordance with certain exemplary embodiments of the present invention. Now referring to FIGS. 1, 2, and 3, a jacket sleeve 300 includes a jacket sleeve body 302, an attachment neck 304 positioned along one end of the jacket sleeve body 302, and one or more pull tabs 306 and 308 positioned along an opposing end of the jacket sleeve body 302. In one exemplary embodiment, the jacket sleeve body 302 has a substantially hollow cylindrical shape, with an inner diameter that is greater than the outer diameter of the cable 26. In one exemplary embodiment, the length of the jacket sleeve body 302 is designed to be greater than the length of cable 26 that is typically stripped for connection to the elbow connector 12 and is exposed outside of the elbow connector 12 after connection thereto. The inner and outer diameters of the jacket sleeve body 302 may be consistent or vary, such as having differing inside diameters along different portions of the longitudinal axis of the jacket sleeve body 302, as may be desired for particular applications.

The jacket sleeve body 302, neck 304 and tabs 306, 308 can be made of EPDM, rubber, silicone or other suitable materials known to those of ordinary skill in the art. The jacket sleeve body 302, neck 304, and pull tabs 306, 308 are generally made of a material that is more pliable than the semiconductive shield 212 of the elbow connector 12. By making the jacket sleeve 300 from a material that is more pliable than the semiconductive shield 212, it will be easier to stretch the jacket sleeve 300 over the exposed portion of the cable after mastic and tape have been applied. In certain exemplary embodiments, the jacket sleeve body 302, neck 304 and tabs 306, 308 are made of EPDM. In another exemplary embodiment, the semiconductive shield 212, jacket sleeve body 302, neck 304, and pull tabs 306 are made of different types of rubber, with the rubber used in the semiconductive shield 212 having a higher durometer than the rubber used in the jacket sleeve body 302, neck 304 and pull tabs 306, 308. In an alternative embodiment, the semiconductive shield 212, the jacket sleeve body 302, neck 304 and tabs 306, 308 are all made from a semiconductive material, wherein the semiconductive material used to make the jacket sleeve body 302, neck 304 and pull tabs 306, 308 has a reduced amount of carbon black or an increased amount of oil such that the material has an increased pliability over the material used to make the semiconductive shield 212 for the elbow connector 12.

The attachment neck 304 is attached or forms an integral part of the jacket sleeve body 302 and, in certain exemplary embodiments, has an inner diameter that is smaller than the inner diameter of the jacket sleeve body 302. In embodiments where the neck 304 is attached to the jacket sleeve body 302, known attachment means may be used, including, but not limited to adhesives and glue. In certain exemplary embodiments, the outer diameter of the neck 304 is also smaller than the outer diameter of the jacket sleeve body 302. The inner diameter of the neck 304 is typically larger than the outer diameter of the elbow connector 12 in an area substantially adjacent to the cable receiving aperture 236. Alternatively, the neck 304 may have the same inner and outer diameter as the jacket sleeve body 302 such that the neck 304 and jacket sleeve body 302 are one and the same. The neck 304 is typically positioned over the elbow connector 12 in an area substantially adjacent to the cable receiving aperture 236.

The pull tabs 306, 308 are integrally connected to the jacket sleeve body 302 along the end of the jacket sleeve body 302 opposite the neck 304. The tabs 306, 308 are generally made of the same material as the neck 304 and the jacket sleeve body 302. While the exemplary embodiment of FIG. 3 presents only two tabs, those of skill in the art will recognize that the use of one, three, or even more tabs is within the scope of the present invention. The tabs 306, 308 may be positioned equidistant from one another along the circumference of the jacket sleeve body 302 or, in the alternative, the tabs 306, 308 may have an unequal spacing arrangement. Each tab 306, 308 extends along a longitudinal axis from the end of the jacket sleeve body 302 opposite the neck 304 in a direction opposite the neck 304. In certain exemplary embodiments, the tabs 306, 308 are formed as a continuation of the jacket sleeve body 302 with recesses cut into the jacket sleeve body 302. In other embodiments, the tabs 306, 308 are independent extensions permanently affixed to the jacket sleeve body 302 along the exterior or interior thereof. In other exemplary embodiments, each tab 306, 308 has a radius of curvature that is equal to or substantially equal to the radius of curvature of the jacket sleeve body 302. Each tab 306, 308 can have an end that is straight (not shown), rounded (as shown), or any other shape or curvilinear dimension.

Each tab 306, 308 includes an operating eye, slot or hole, such as slots 310, 312. The slots 310, 312, can have many different types of shapes and sizes known to those of ordinary skill in the art including, but not limited to oval, circular, diamond, quadrilateral, square, rectangular, and half-moon-shaped, just to name a few. In certain exemplary embodiments, the size of the slot 310, 312 is sufficient to accommodate the thumb of an average man. A reinforcement strip 316 can be included along all or a portion of the edge of each slot 310, 312. The reinforcement strip 316 is typically an increased thickness of the material making up the tab 306, 308 and provides increased strength and durability along the edges of the slot 310, 312.

In other embodiments, the tabs 306, 308 can be replaced with an extension of the jacket sleeve body 302 having a circular cross-section (not shown). One or more slots 310, 312 may be cut out, or molded, into the jacket sleeve body 302 and have a shape and size similar to that described hereinabove. The jacket sleeve 300 may also include one or more ribs 314. Although only shown around tab 306, ribs may also be positioned along the neck 304 and/or jacket sleeve body 302. Each rib 314 typically extends along the longitudinal axis of the exterior of the neck 304, jacket sleeve body 302, and/or tabs 306, 308. However, the ribs 314 may also extend circumferentially, diagonally or in any other pattern or combination of patterns along the jacket sleeve 300. Each rib 314 is typically made of the same material as the jacket sleeve body and has a thickness that is greater than the body of the portion of the jacket sleeve the rib 314 is positioned along. The ribs 314 are designed to provide improved strength characteristics for the portion of the jacket sleeve along which they extend.

The jacket sleeve 300 can be integral to or created separately from the body of the elbow connector 12. For example, the jacket sleeve 300 and the elbow connector 12 can be molded separately using known molding methods and the jacket sleeve 300 is affixed to the exterior of the elbow connector 12 near the cable receiving aperture 236 via glue or another known adhesive. As another example, the molded elbow connector 12 can be placed into a second mold so that the jacket sleeve 300 can be overmolded onto the elbow connector 12, thereby bonding the jacket sleeve 300 to the elbow connector 12.

As still another example, the elbow connector 12 and the jacket sleeve 300 can be created using co-injection molding. Using co-injection molding, the elbow connector 12 and the jacket sleeve 300 can be made integral to one another at the same time using a single mold. Using co-injection molding technology, which is known in the art, a semiconductive material having a higher durometer can be injected into one side of the mold and a softer, more pliable material having a lower durometer can be injected into the other side of the mold. The two materials would meet substantially near the neck 302 of the jacket sleeve 300, wherein the semiconductive material would make up a substantial portion of the elbow connector 12 and the more pliable material would make up a substantial portion of the jacket sleeve 300.

Figure 4:
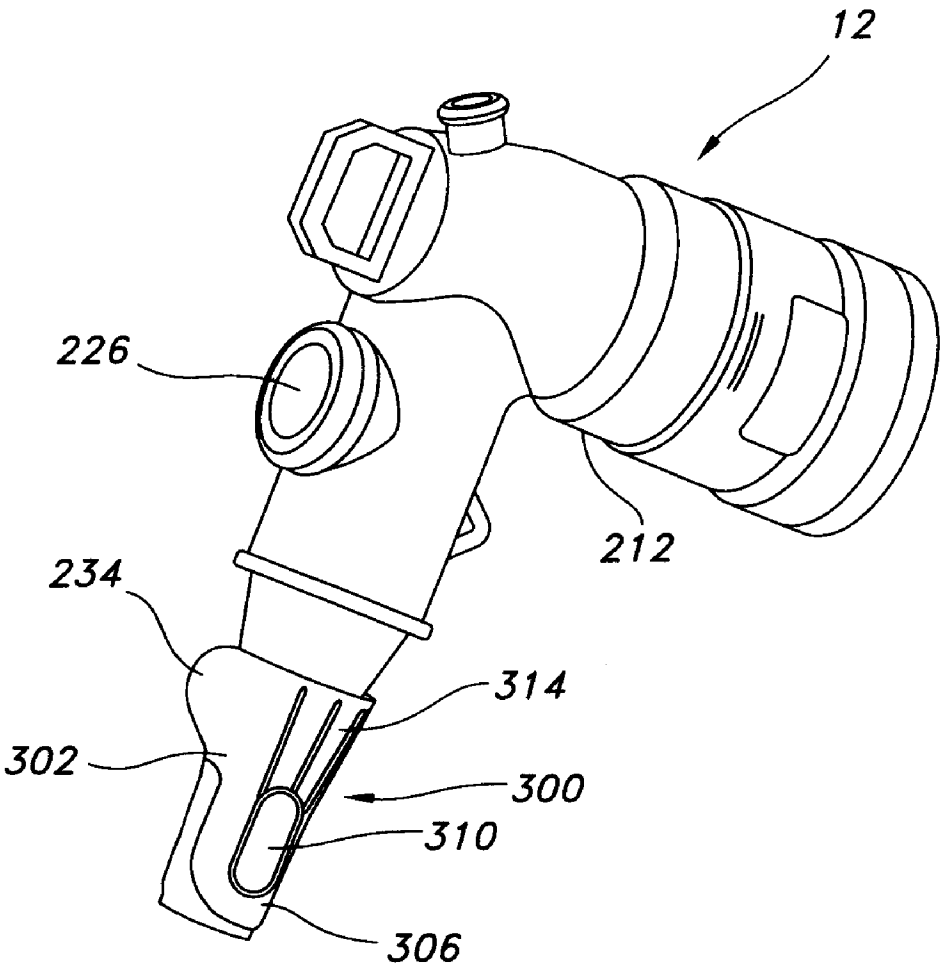
FIG. 4 shows a perspective view of the jacket sleeve in a retracted orientation positioned adjacent to the cable receiving aperture and connected to the exemplary loadbreak connector in accordance with one exemplary embodiment of the present invention.

FIG. 4 shows a perspective view of the jacket sleeve 300 in a retracted orientation positioned adjacent to the cable receiving aperture 236 and affixed to the exemplary elbow connector 12 in accordance with one exemplary embodiment of the present invention. Now referring to FIGS. 2 and 4, the exemplary jacket sleeve 300 is shown folded upon itself along a portion of the elbow connector 12 such that a portion of the jacket sleeve body 302 is covering the grounding eye 234. The exemplary positioning of the jacket sleeve 300 shown in FIG. 4 is typically initiated prior to placing the cable 26 into the cable receiving aperture 236. Once the cable 26 has been inserted into the cable receiving aperture 236 and affixed to the elbow connector 12, a lineperson can grasp each of the slots 310, 312 with one or more of his fingers, which include the thumbs, and pull the jacket sleeve body 302 in the direction of the exposed cable 26 until the jacket sleeve body 302 is extended to cover the exposed portion of the cable 26. While the exemplary embodiment of FIG. 4 shows the jacket sleeve 300 folded upon itself, those of ordinary skill in the art will recognize that there are many ways to position the jacket sleeve 300 along the exterior of the elbow connector 12 to make the aperture 236 more accessible while positioning the slots 310, 312 in an accessible position for the lineperson once the cable 26 has been attached.

Figure 5:
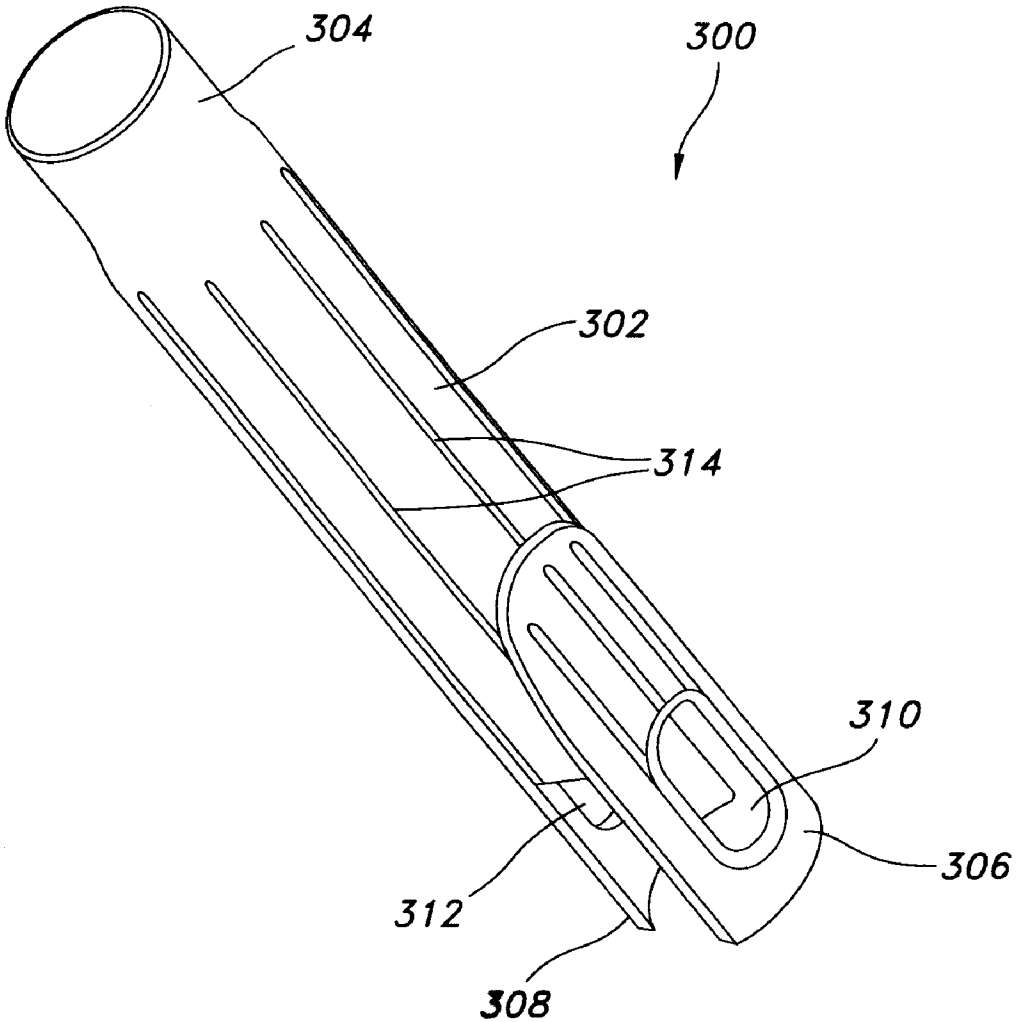
FIG. 5 is a perspective view of the jacket sleeve in an extended orientation in accordance with one exemplary embodiment of the present invention.

FIG. 5 presents a perspective view of the exemplary jacket sleeve 300' of FIG. 3 in an extended orientation. Now referring to FIGS. 3 and 5, the jacket sleeve 300' of FIG. 5 is substantially similar to that shown and described in FIG. 3. The exemplary jacket sleeve 300' includes multiple ribs 314 that extend along the longitudinal axis of both the jacket sleeve body 302 and the tabs 306, 308. In addition, tabs 306, 308 of FIG. 5 have a larger outside diameter than the outside diameter the jacket sleeve body 302. Furthermore, the neck 304 has an outside diameter that is smaller than the outside diameter of the jacket sleeve body 302. As discussed hereinabove, the jacket sleeve 300' may be molded in a separate operation from the molding operation of the elbow connector 12. The neck 304 of the jacket sleeve 300' may then be attached to the elbow connector 12 adjacent to the cable receiving aperture 236.

Figure 6:
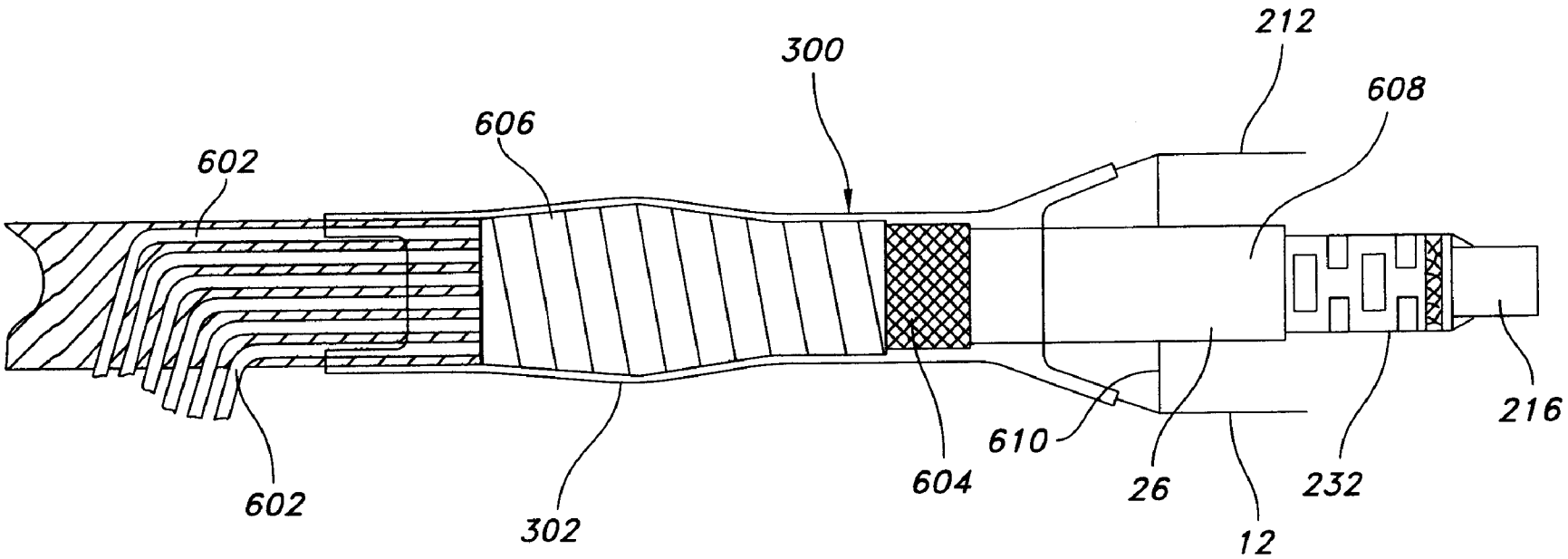
FIG. 6 is a cross-sectional view of a junction area between the cable and the loadbreak connector in accordance with one exemplary embodiment of the present invention.

FIG. 6 is a cross-sectional view of a junction area between the cable 26 and the elbow connector 12 in accordance with certain exemplary embodiments of the present invention. Referring now to FIGS. 2, 3, and 6, the exemplary junction area includes a conductor contact 216 attached to one end of a compression connector 232. The other end of the compression connector 232 is attached to the cable 26. The cable 26 may include the following layers (from interior to exterior): a conductor, conductor shield, insulation, insulation shield, concentric neutrals, and a cable jacket. One or more of the layers may be stripped back to expose the underlying layers. Typically, the conductor shield, insulation, insulation shield, concentric neutrals, and cable jacket layers of the cable 26 are stripped back at the compression connector 232 so that the conductor 608 of the cable 26 can be affixed to the compression connector 232.

To limit the amount of water and other elements that may come into contact with the inner layers of the cable 26, the jacket sleeve 300 and other materials are placed around the exposed portions of the cable 26 along the jacket body 302 portion of the jacket sleeve 300. For example, mastic 604, or another form of gum, resin, or adhesive, may be placed on the exposed portions of the cable 26, including over the concentric neutrals 602. The objective of the mastic 604 is to prevent water or other elements or dirt from reaching the concentric neutrals 602 and corroding them or other portions of the cable 26.

Electrical tape 606 or other forms of tape may be wrapped around the mastic 604 and the exposed portions of the cable 26. The electrical tape 606 may help to maintain the general shape of the mastic 604 and keep the mastic 604 in contact with the exposed portions of the cable 26. Once the tape 606 and mastic 604 are in place, the jacket sleeve 300, which is positioned along the cable receiving aperture 236 of the elbow connector 12 along the semiconductive layer 212, may be grasped at the slots 308, 310 and pulled toward the portion of the cable 26 covered with mastic 604 and tape 606 until the jacket sleeve 300 completely covers the mastic 604 and taped 606 portion of the cable 26 and the jacket sleeve 300 has an interference fit with the taped portion of the cable 26 along the jacket body 302. In certain embodiments, the objective of the jacket sleeve 300 is not to create a water-tight or element-tight seal but is instead to hold or substantially hold the mastic 604 and tape 606 in position over the exposed portion of the cable 26.

In certain embodiments, the method of connecting a cable 26 to the elbow connector 12 and protecting the exposed portion of the cable 26 with a jacket sleeve 300 begins by wrapping a strip of mastic 604 around the exterior cable jacket. The cable jacket can then be stripped off of a portion of the cable 26. The exposed concentric neutrals 602 of the cable 26 are bent back along the length of the cable 26 and over the mastic 604. The concentric neutrals 602 are pressed into the mastic 604 and additional mastic 604 is wrapped around the insulation shield, cable jacket, and concentric neutrals embedded in the first layer of mastic 604. Additional mastic 604 or electrical tape 606 may be added on top of the second layer of mastic 604 if necessary to build up the diameter of the protected area so that the jacket sleeve 300 will make an interference fit along the jacket body 302 with the tape 606 that is subsequently wrapped around the mastic 604.

Next, the insulation and the insulation shield are removed from the exposed end of the cable 26. A compression connector 232 is connected to the conductor 608 of the cable 26 and rotated to spread the inhibitor of the compression connector 232. The cable 26 and cable receiving aperture 236 are lubricated and the elbow connector 12 is slid down upon the conductor 608 of the cable 26. A copper wire or other equivalent is attached to the grounding eye 234. The lineperson then grabs the jacket sleeve 300 by placing one or more fingers through each of the slots 310, 312. The lineperson pulls the jacket sleeve 300 in the direction of the mastic covered cable 26 to a point such that the jacket sleeve body 302 covers the exposed portion of the cable 26 outside of the elbow connector 12. The copper wire is attached to ground 6 and the elbow connector 12 is attached to the switchgear 8 or transformer.

In conclusion, the present invention is directed to a jacket sleeve having pull tabs for use with elbow connectors and other electrical products in which exposed wire or cable must be protected. In addition, the present invention is directed to methods of making and using a jacket sleeve with pull tabs. The foregoing description relates to certain exemplary embodiments of the present invention; it will be evident to those of ordinary skill in the art that various modifications and changes may be made thereto without departing from the spirit and the scope of the present invention as set forth in the appended claims and equivalents thereof.

We claim:

1. An electrical connector, comprising:

a connector body comprising:

an insulated housing;

a channel in the insulated housing defining a space for receiving a conducting electrical cable therein; and an aperture in a first end of the channel, wherein the aperture provides an entry point for positioning the conducting electrical cable into the channel;

a pliable, elongated, elastomeric jacket sleeve comprising a first end, a second end, and a hollow tubular body, wherein the first end of the jacket sleeve is coupled to the insulated housing of the connector body along a position adjacent to the aperture; and at least a pair of slots, the each slot positioned along an outer periphery of the hollow tubular body and adjacent to the second end of the jacket sleeve, wherein the each slot provides an access point for grasping the jacket sleeve, wherein the each slot comprises a through hole.

2. The electrical connector of claim 1, further comprising at least a pair of pull tabs coupled to the second end of the jacket sleeve, wherein the each slot is positioned along a periphery of one of the pull tabs and extends therethrough.

3. The electrical connector of claim 2, wherein the first end of the jacket sleeve is coupled to the insulated housing of the connector body by being integral with the insulated housing, and wherein the pull tabs are integral with the jacket sleeve.

4. The electrical connector of claim 2, wherein the jacket sleeve and pull tabs are operable to be initially folded back upon themselves over the first end of the channel so as to limit engagement of the jacket sleeve with a conducting electrical cable until after a portion of the cable is inserted into the channel.

5. The electrical connector of claim 2, wherein the connector body comprises a first material and the jacket sleeve and pull tabs comprise a second material, said second material being more pliable than the first material.

6. The electrical connector of claim 5, wherein each of the first material and the second material comprises rubber, said second material having a lower durometer than the first material.

7. The electrical connector of claim 2, further comprising at least one rib integral to and extending along at least a portion of a longitudinal length of at least one of the pull tabs.

8. The electrical connector of claim 2, wherein each of the pull tabs extends in a longitudinal direction away from the aperture.

9. The electrical connector of claim 1, wherein the jacket sleeve forms a barrier to the ingress of moisture into a conducting electrical cable inserted into the channel of the insulated housing.

10. The electrical connector of claim 1, further comprising a molded contact tube assembly disposed at least partially within the insulated housing, wherein the molded contact tube assembly has a first end and a second end, said first end being positioned proximate a rim of the insulated housing, the second end being positioned substantially proximate a middle of the insulated housing.

11. The electrical connector of claim 1, wherein the insulated housing comprises a conductive material.

12. The electrical connector of claim 1, wherein the each slot comprises an oval shape.

13. The electrical connector of claim 1, further comprising at least one rib integral to and extending along at least a portion of a longitudinal length of the jacket sleeve.

14. The jacket sleeve of claim 1, wherein the each slot comprises an opening sized to receive an adult finger inserted therein.

15. The electrical connector of claim 1, wherein the first end of the jacket sleeve is coupled to the insulated housing of the connector body by being integral with the insulated housing.

16. An electrical connector, comprising:

a connector body comprising an insulated housing defining a channel;

an elongated, elastomeric jacket sleeve comprising a first end, a second end, and a tubular body, the first end being coupled to the insulated housing, at least partially around a portion of the channel;

at least a pair of slots, the each slot positioned along an outer periphery of the tubular body, adjacent to the second end of the jacket sleeve; and at least two pull tabs coupled to the second end of the jacket sleeve, wherein the each slot is positioned along a periphery of one of the pull tabs and extends therethrough, and wherein the each slot comprises a through hole.

17. The electrical connector of claim 16, wherein the jacket sleeve is coupled to the insulated housing by being integral with the insulated housing, and wherein the pull tabs are integral with the jacket sleeve.

18. The electrical connector of claim 16, wherein the jacket sleeve and pull tabs are operable to be initially folded back upon themselves over a first end of the channel so as to limit engagement of the jacket sleeve with a cable until after a portion of the cable is inserted into the channel.

19. The electrical connector of claim 16, wherein the connector body comprises a first material and the jacket sleeve and pull tabs comprise a second material, the second material being more pliable than the first material.

20. The electrical connector of claim 19, wherein each of the first material and the second material comprises rubber, the second material having a lower durometer than the first material.

21. The electrical connector of claim 16, further comprising at least one rib integral to and extending along at least a portion of a longitudinal length of at least one of the pull tabs.

22. The electrical connector of claim 16, wherein the jacket sleeve forms a barrier to the ingress of moisture into a cable inserted into the channel of the insulated housing.

23. The electrical connector of claim 16, further comprising a molded contact tube assembly disposed within the insulated housing, the molded contact tube assembly having a first end and a second end, the first end being positioned proximate a rim of the insulated housing, the second end being positioned substantially proximate a middle of the insulated housing.

24. The electrical connector of claim 16, wherein the insulated housing comprises a conductive material.

25. The electrical connector of claim 16, wherein the each slot comprises an oval shape.

26. The electrical connector of claim 16, further comprising at least one rib integral to and extending along at least a portion of a longitudinal length of the jacket sleeve.

27. The jacket sleeve of claim 16, wherein the each slot comprises an opening sized to receive an adult finger inserted therein.

28. The electrical connector of claim 16, wherein the first end of the jacket sleeve is coupled to the insulated housing of the connector body by being integral with the insulated housing.

29. The electrical connector of claim 16, wherein each of the pull tabs extends in a longitudinal direction away from the insulated housing.

30. A connector body for an electrical connector, comprising:

a housing comprising an insulating layer, a channel that defines a space for receiving a conducting electrical cable, and an aperture in a first end of the channel;

an elongated, elastomeric jacket sleeve coupled to the housing and comprising a hollow tubular body and at least two slots therein, wherein at least a portion of the jacket sleeve extends longitudinally beyond the insulated layer, wherein the each slot is positioned within the portion of the jacket sleeve that extends longitudinally beyond the insulated layer, and wherein the each slot comprises a through hole.

31. The electrical connector of claim 30, further comprising at least a pair of pull tabs coupled to the jacket sleeve, wherein the each slot is positioned along a periphery of one of the pull tabs and extends therethrough.

32. The electrical connector of claim 31, wherein the pull tabs do not include insulating material.

33. The electrical connector of claim 31, wherein the pull tabs are integral with the jacket sleeve.

34. The electrical connector of claim 30, wherein the jacket sleeve is integral with the insulated housing.

* * * * *